US012722094B2

(12) United States Patent
Sugimatsu et al.

(10) Patent No.: US 12,722,094 B2
(45) Date of Patent: Sep. 1, 2026

(54) YO-YO

(71) Applicant: BANDAI CO., LTD., Tokyo (JP)

(72) Inventors: Kazuyuki Sugimatsu, Tokyo (JP); Kenta Kai, Tokyo (JP); Yuki Omure, Tokyo (JP); Hans Van Dan Elzen, Chandler, AZ (US)

(73) Assignee: BANDAI CO., LTD., Tokyo (JP)

( * ) Notice: Subject to any disclaimer, the term of this patent is extended or adjusted under 35 U.S.C. 154(b) by 253 days.

(21) Appl. No.: 18/617,652

(22) Filed: Mar. 27, 2024

(65) Prior Publication Data

US 2025/0242269 A1 Jul. 31, 2025

(30) Foreign Application Priority Data

Jan. 31, 2024 (JP) ..... 2024-013787

(51) Int. Cl.
*A63H 1/30* (2006.01)

(52) U.S. Cl.
CPC ..... *A63H 1/30* (2013.01)

(58) Field of Classification Search
CPC ..... A63H 1/30
USPC ..... 446/247, 248, 250
See application file for complete search history.

(56) References Cited

U.S. PATENT DOCUMENTS 1,793,151 A * 2/1931 Asbury ..... A63H 1/30 446/250
2,676,432 A * 4/1954 Field ..... A63H 1/30 446/315
3,256,635 A * 6/1966 Radovan ..... A63H 1/30 446/251
3,263,361 A * 8/1966 Bowden ..... A63H 5/00 446/265
3,287,846 A * 11/1966 Frangos ..... A63H 1/00 446/250
3,643,373 A * 2/1972 Russell ..... A63H 1/30 446/245
4,555,235 A * 11/1985 Burroughs ..... A63H 1/30 446/250

(Continued)

FOREIGN PATENT DOCUMENTS

JP 3047740 U 4/1998
JP 2003-135859 A 5/2003

(Continued)

OTHER PUBLICATIONS

May 7, 2024, Japanese Office Action issued for related JP Application No. 2024-013787.

(Continued)

*Primary Examiner* — Alexander R Niconovich
(74) *Attorney, Agent, or Firm* — Paratus Law Group, PLLC

(57) ABSTRACT

A yo-yo includes: a shaft member; a string member supported by the shaft member; a first rotation portion rotatable around the shaft member; and a second rotation portion rotatable around the shaft member and rotatable relative to the corresponding first rotation portion. The second rotation portion is provided outside the first rotation portion in a direction in which the shaft member extends, the second rotation portion covers a partial area of the first rotation portion, and at least a part of the partial area is visible through the second rotation portion.

17 Claims, 9 Drawing Sheets

(56) References Cited

U.S. PATENT DOCUMENTS 5,356,328 A * 10/1994 Ho ..... A63H 1/24 446/253
5,769,686 A * 6/1998 Duncan ..... A63H 1/30 446/250
5,984,759 A * 11/1999 O'Sullivan ..... A63H 1/32 446/250
6,196,891 B1 * 3/2001 Jamison ..... A63H 1/30 446/250
6,579,142 B1 * 6/2003 Rehkemper ..... A63H 1/30 446/250
6,599,165 B1 * 7/2003 Van Dan Elzen ..... A63H 1/30 446/236
7,281,965 B2 * 10/2007 Torres ..... A63H 1/02 446/256
7,448,934 B2 * 11/2008 Van Dan Elzen ..... A63H 29/22 446/236
7,740,517 B2 * 6/2010 Hochstrasser ..... A63H 1/30 446/250
7,874,890 B2 * 1/2011 Van Dan Elzen ..... A63H 1/30 446/248
7,874,891 B2 * 1/2011 Van Dan Elzen ..... A63H 1/30 446/236
8,187,052 B2 * 5/2012 Van Dan Elzen ..... A63H 1/30 446/250
8,764,509 B1 * 7/2014 Lytle ..... A63H 1/30 446/250
8,851,954 B2 * 10/2014 McCafferty ..... A63H 1/30 446/250
9,079,112 B2 * 7/2015 Hasegawa ..... A63H 1/30
9,950,266 B2 * 4/2018 Cai ..... A63H 1/30
10,150,044 B2 * 12/2018 Shlomot ..... H04R 1/028
2008/0171488 A1 7/2008 Van Dan Elzen
2012/0276806 A1 * 11/2012 Wu ..... A63H 1/30 446/250
2017/0239582 A1 8/2017 Cai

FOREIGN PATENT DOCUMENTS

JP 2013-094601 A 5/2013
JP 2017-522055 A 8/2017

OTHER PUBLICATIONS

Sep. 30, 2024, Japanese Office Action issued for related JP Application No. 2024-013787.

* cited by examiner

YO-YO

CROSS-REFERENCE RELATED APPLICATIONS

This application is based on and claims priority under 35 USC 119 from Japanese Patent Application No. 2024-013787 filed on Jan. 31, 2024, the contents of which are incorporated herein by reference.

TECHNICAL FIELD

The present disclosure relates to a yo-yo.

BACKGROUND

Registered Utility Model No. 3047740 (hereinafter, referred to as Patent Literature 1) discloses a yo-yo in which a decorative body such as a photograph can be stored in a disk-shaped side body.

In Patent Literature 1, the yo-yo capable of storing the decoration body such as a photograph in the disk-shaped side body is disclosed, but a yo-yo with higher interest is favorable.

The present disclosure relates to providing a yo-yo with improved interest.

SUMMARY

An aspect of the present disclosure relates to a yo-yo including: a shaft member; a string member supported by the shaft member; a first rotation portion rotatable around the shaft member; and a second rotation portion rotatable around the shaft member and rotatable relative to the corresponding first rotation portion. The second rotation portion is provided outside the first rotation portion in a direction in which the shaft member extends, the second rotation portion covers a partial area of the first rotation portion, and at least a part of the partial area is visible through the second rotation portion.

BRIEF DESCRIPTION OF DRAWINGS

Exemplary embodiments of the present disclosure will be described in detail based on the following figures, wherein.

DESCRIPTION OF EMBODIMENTS

Hereinafter, a yo-yo according to an embodiment of the present disclosure will be described with reference to the drawings.

Figure 1:
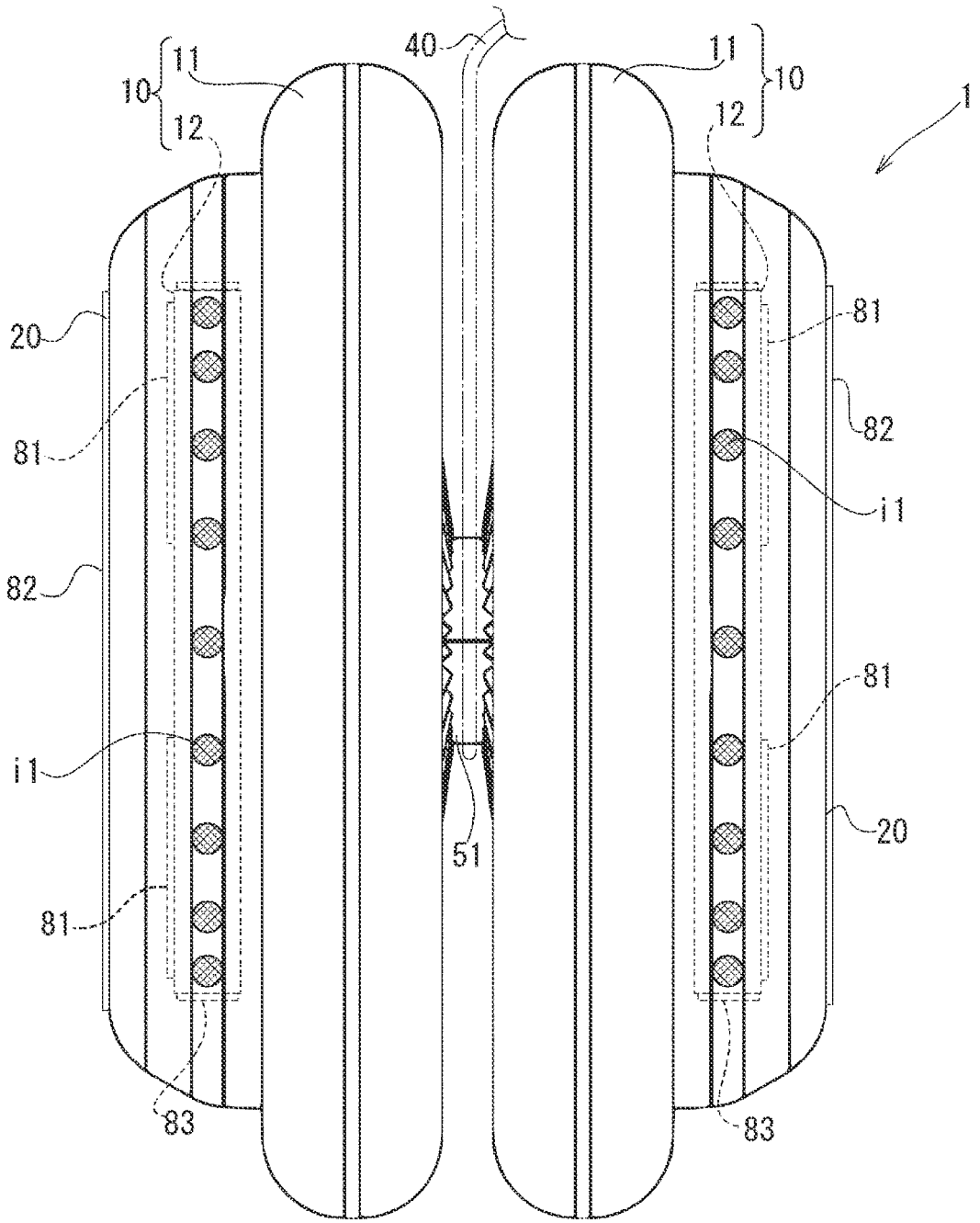
FIG. 1 is a front view of an embodiment representing one aspect of the present disclosure.
Figure 2:
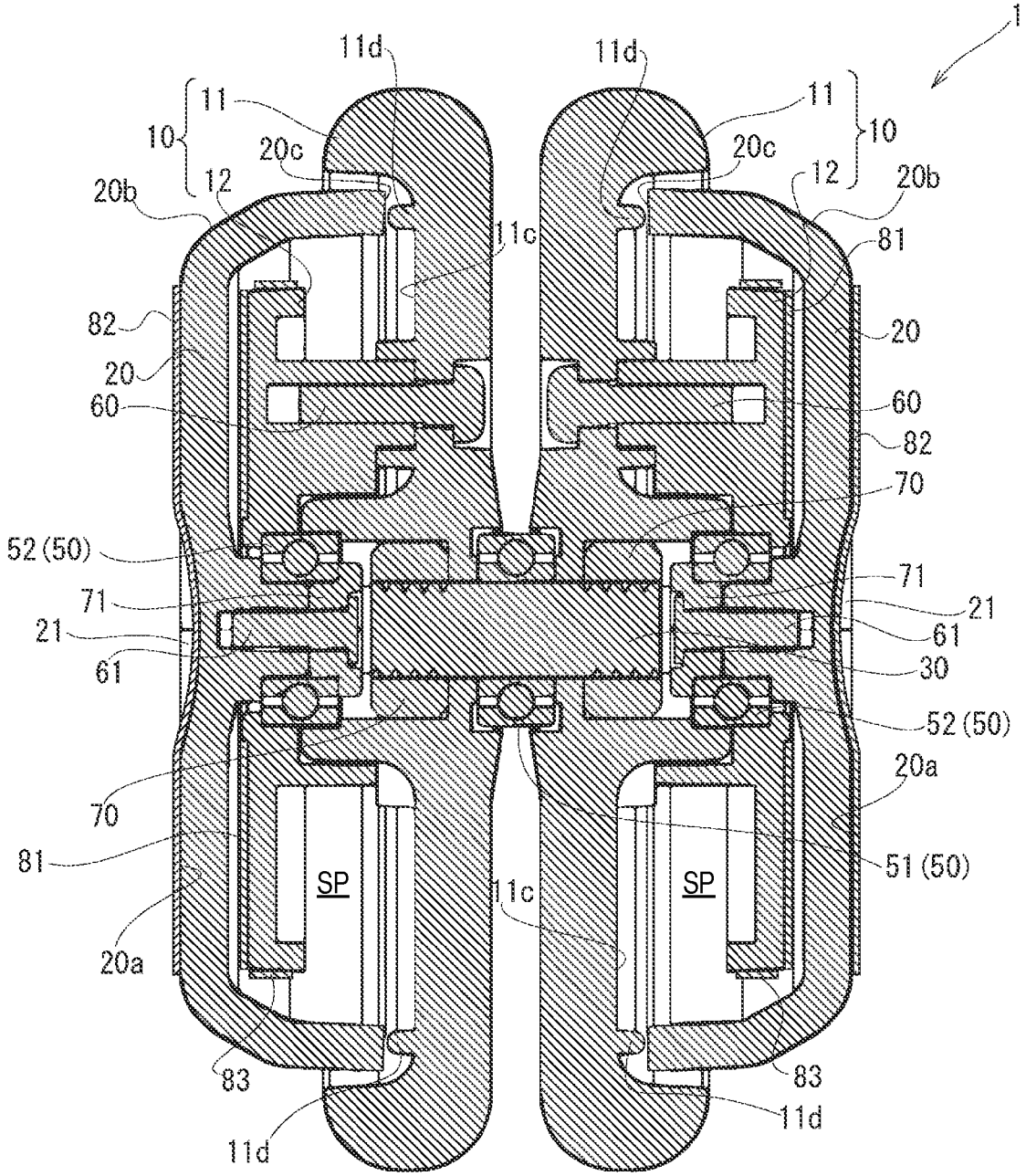
FIG. 2 is a sectional view showing an inner portion of a yo-yo of FIG. 1.

FIG. 1 is a front view of a yo-yo 1, and FIG. 2 is a cross-sectional view showing an inner portion of the yo-yo 1.

The yo-yo 1 shown in FIGS. 1 and 2 includes a shaft member 30, a pair of left and right first rotation portions 10 rotatable around the shaft member 30, and a pair of left and right second rotation portions 20 rotatable around the shaft member 30 and rotatable relative to the first rotation portions 10 outside the first rotation portions. A bearing 50 (first bearing 51) is provided around the shaft member 30 between the left and right first rotation portions 10. Further, a string member 40 supported by the first bearing 51 and capable of being wound around the first bearing 51 is provided in a space formed between the first rotation portions 10.

The first rotation portion 10 has a structure in which a disk-shaped main body portion 11 rotatably supported by the shaft member 30 and an interlocking member 12 having a diameter smaller than that of the main body portion 11 on an outer side in an axial direction of the main body portion 11 are integrally coupled. The main body portion 11 and the interlocking member 12 are formed as separate members as described later. Further, the left and right main body portions 11 and interlocking members 12 are coupled and integrated to each other via the shaft member 30.

The main body portion 11 is a member having the largest thickness, and has a circular recessed portion 11*c* on an outer surface side in the axial direction. In the recessed portion 11*c*, an annular abutting portion 11*d* protruding outward in the axial direction is provided at a bottom portion of the recessed portion 11*c*. In the present embodiment, the abutting portion 11*d* has an annular shape, but is not limited to such a shape. For example, plural abutting portions 11*d* may be provided with a predetermined distance apart from each other.

The interlocking member 12 includes, on an outer side surface thereof in the axial direction, a thin plate-shaped rotation surface 12*a* that is rotatable in conjunction with the main body portion 11 in a state of being attached to the main body portion 11. That is, the rotation surface 12*a* faces a side surface side of the yo-yo 1. A first sheet 81 is attached to the rotation surface 12*a*. Further, the interlocking member 12 includes an outer peripheral surface 12*b* in a direction intersecting the rotation surface 12*a*, and a third sheet 83 is attached to the outer peripheral surface 12*b*.

The second rotation portion 20 is disposed outside the interlocking member 12 in the axial direction, and includes a side surface portion 20*a* that is substantially flat and parallel to the rotation surface 12*a*. An outer peripheral end 20*b* on the outer peripheral side of the side surface portion 20*a* extends inward in the axial direction, and an extended distal end edge 20*c* of the outer peripheral end 20*b* faces the abutting portion 11*d*. That is, the second rotation portion 20 has a shape whose end surface side is appropriately curved so as to cover a side surface side and an end surface side of the interlocking member 12. Accordingly, the second rotation portion 20 forms a space SP with the recessed portion 11*c* of the first rotation portion 10. Even when the yo-yo 1 is used, it is favorable that the abutting portion 11*d* and the distal end edge 20*c* are separated from each other.

The second rotation portion 20 is attached to the first rotation portion 10 via the bearings 50 (second bearings 52) disposed on both end sides of the shaft member 30, and is rotatable independently of the first rotation portion 10. The second rotation portion 20 is made of a transparent material, and is configured such that the interlocking member 12 inside the second rotation portion 20 is visible through the second rotation portion 20. Accordingly, the interlocking member 12 has a visual effect different from that of the main body portion 11, and it is possible to see a difference in visual effect between the main body portion 11 and the interlocking member 12. Examples of the visual effect include a change in color and a change in glossiness.

When the yo-yo 1 is viewed from a side (see FIG. 7), the rotation surface 12*a* of the interlocking member 12 is visible. Since the first sheet 81 is provided on the rotation surface 12*a* as described above, for example, a polka dot pattern as first information i1, which will be described later, can be seen from the outside. Here, since the rotation surface 12*a* is disposed close to the second rotation portion 20, the first information i1 can be clearly seen. Furthermore, in a case where the second rotation portion 20 includes a lens-like portion, it is possible to see the first information i1 with the size thereof changed.

A recess 21 is formed in the side surface portion 20*a* of the second rotation portion 20 at a position facing the shaft member 30. The recess 21 can be used to make it easy to hold the yo-yo 1. In addition, in a case where the left and right side surface portions 20*a* of the second rotation portion 20 are gripped so as to be strongly pressed, the abutting portion 11*d* is abuttable against the distal end edge 20*c* of the second rotation portion 20, and in a case where the abutting portion 11*d* and the distal end edge 20*c* abut against each other, the second rotation portion 20 and the rotation surface 12*a* of the interlocking member 12 are separated from each other. This can prevent the second rotation portion 20 and the rotation surface 12*a* of the interlocking member 12 from coming into contact with each other, and prevent their movements from being interfered. As a configuration in which the second rotation portion 20 and the rotation surface 12*a* of the interlocking member 12 are separated from each other when the abutting portion 11*d* and the distal end edge 20*c* abut against each other, in a state in which the yo-yo 1 is not gripped, it is favorable to adjust a protruding length of the abutting portion 11*d* such that a distance between the rotation surface 12*a* of the interlocking member 12 and the second rotation portion 20 facing the rotation surface 12*a* is greater than a distance between the distal end of the rotation portion 11*d* and the distal end edge 20*c*. In the present embodiment, the distal end edge 20*c* faces the abutting portion 11*d*, but the present disclosure is not limited thereto. It is sufficient if a part of the second rotation portion 20 is abuttable against the abutting portion 11*d* facing the part thereof, and the second rotation portion 20 and the rotation surface 12*a* of the interlocking member 12 are separated from each other when the part abuts against the abutting portion 11*d*. However, the configuration of the present embodiment is preferable because it is not necessary to newly provide a protruding portion such as the abutting portion 11*d* in the second rotation portion 20.

Hereinafter, an example of an assembly method for the yo-yo 1 will be described with reference to FIGS. 3 to 6.

Figure 3:
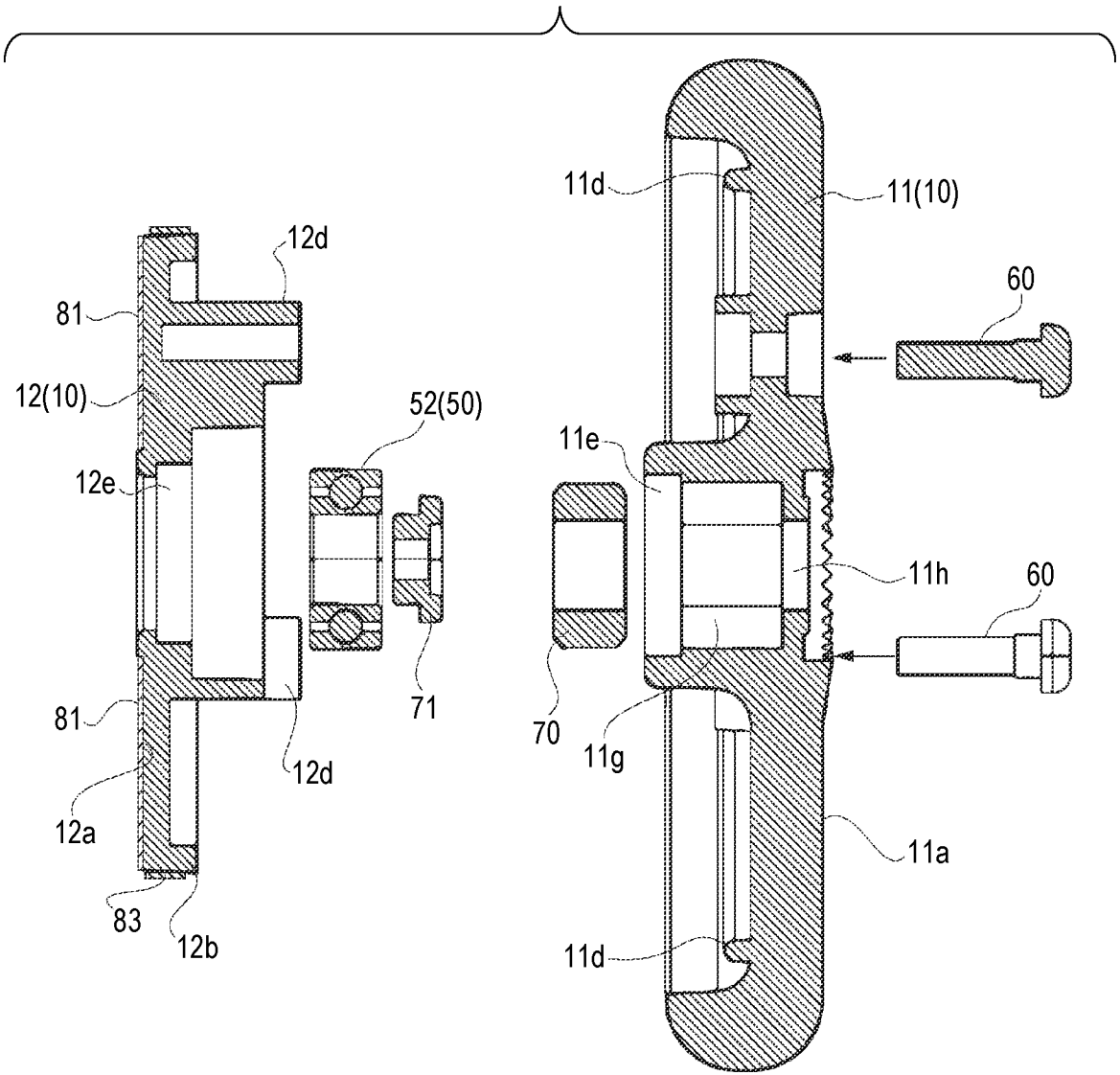
FIG. 3 is a cross-sectional view of the yo-yo shown in FIG. 1 at an initial stage of assembly.
Figure 4:
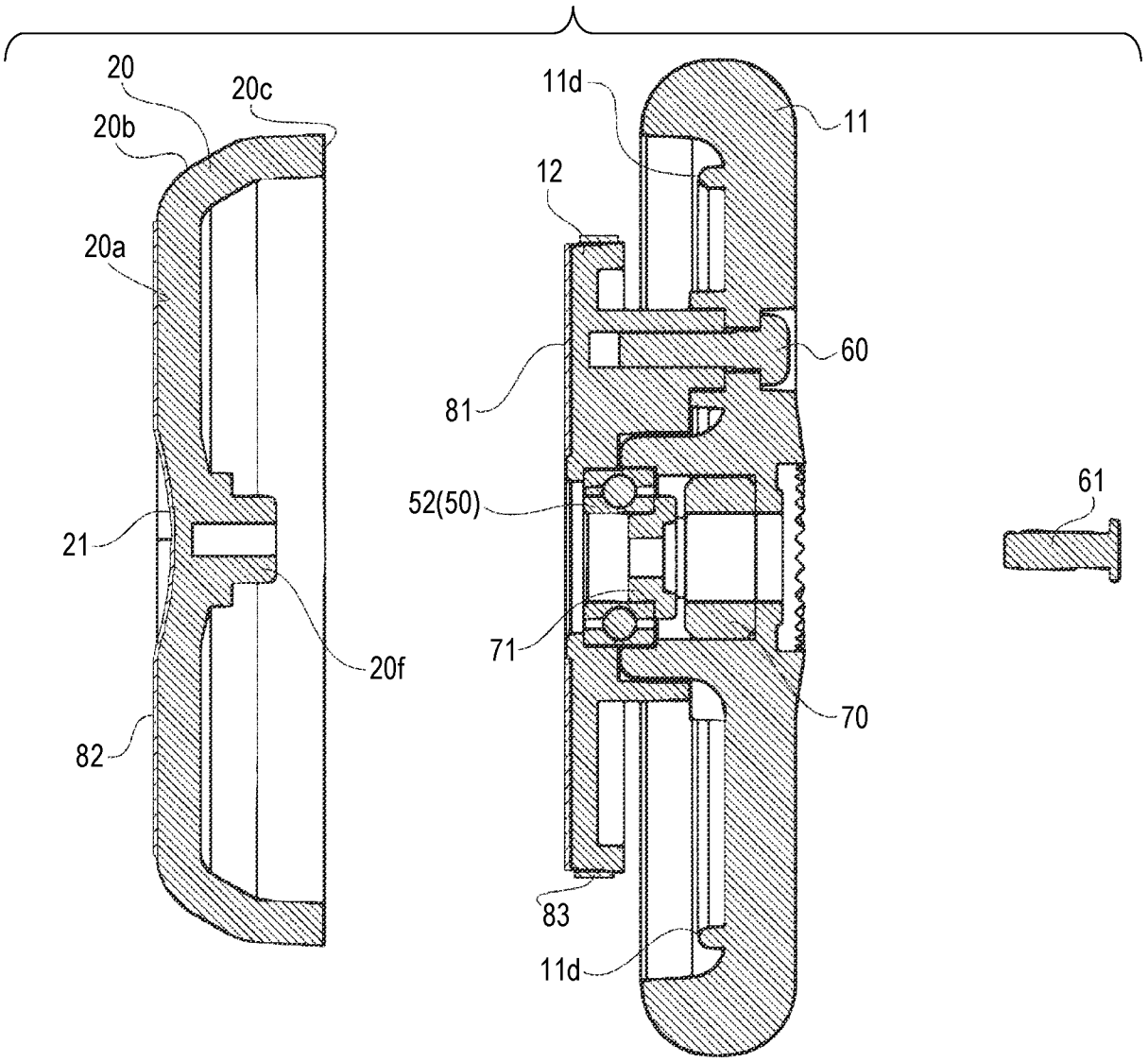
FIG. 4 is a cross-sectional view of the yo-yo shown in FIG. 1 at a middle stage of assembly.
Figure 5:
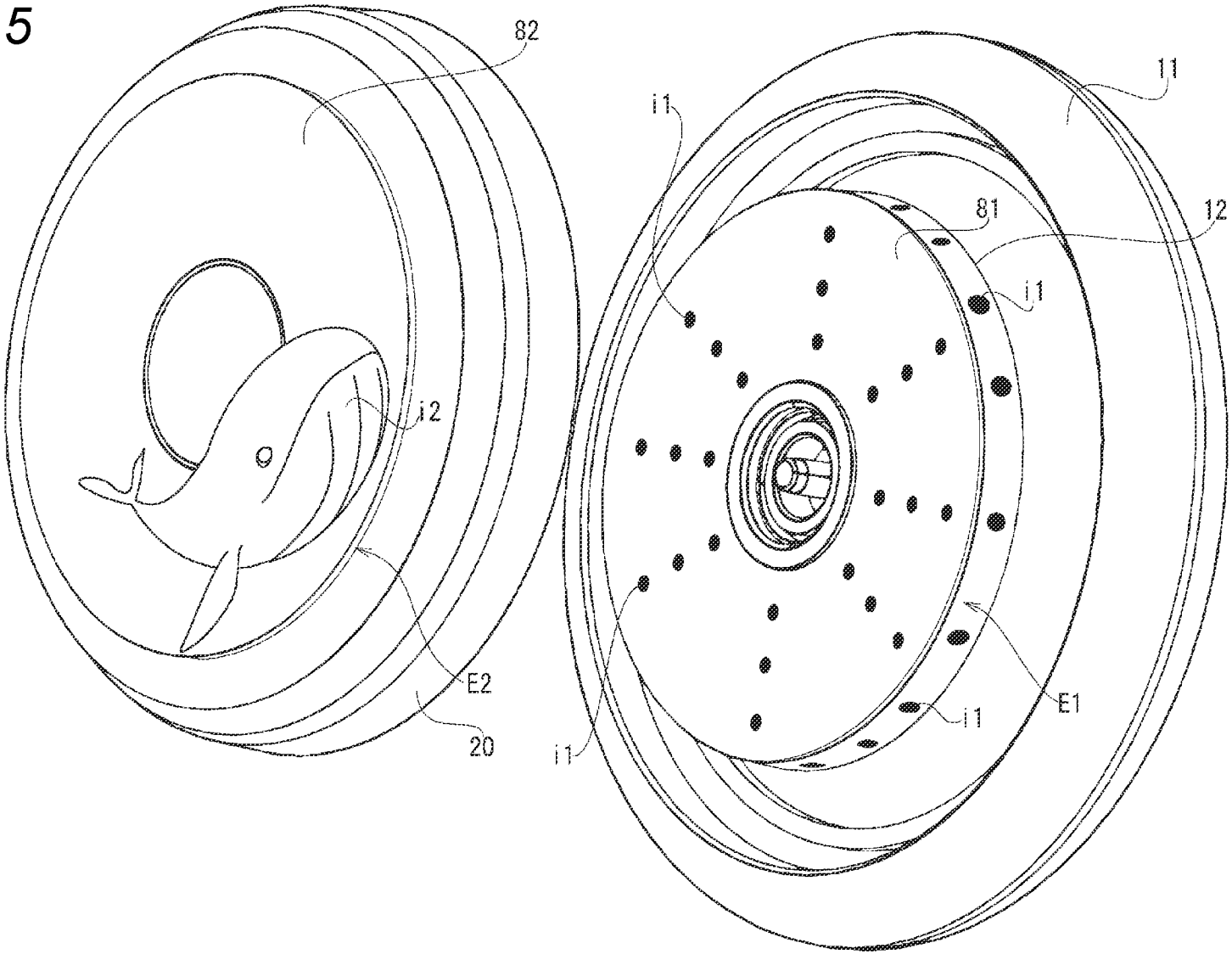
FIG. 5 is a perspective view of the state shown in FIG. 4.
Figure 6:
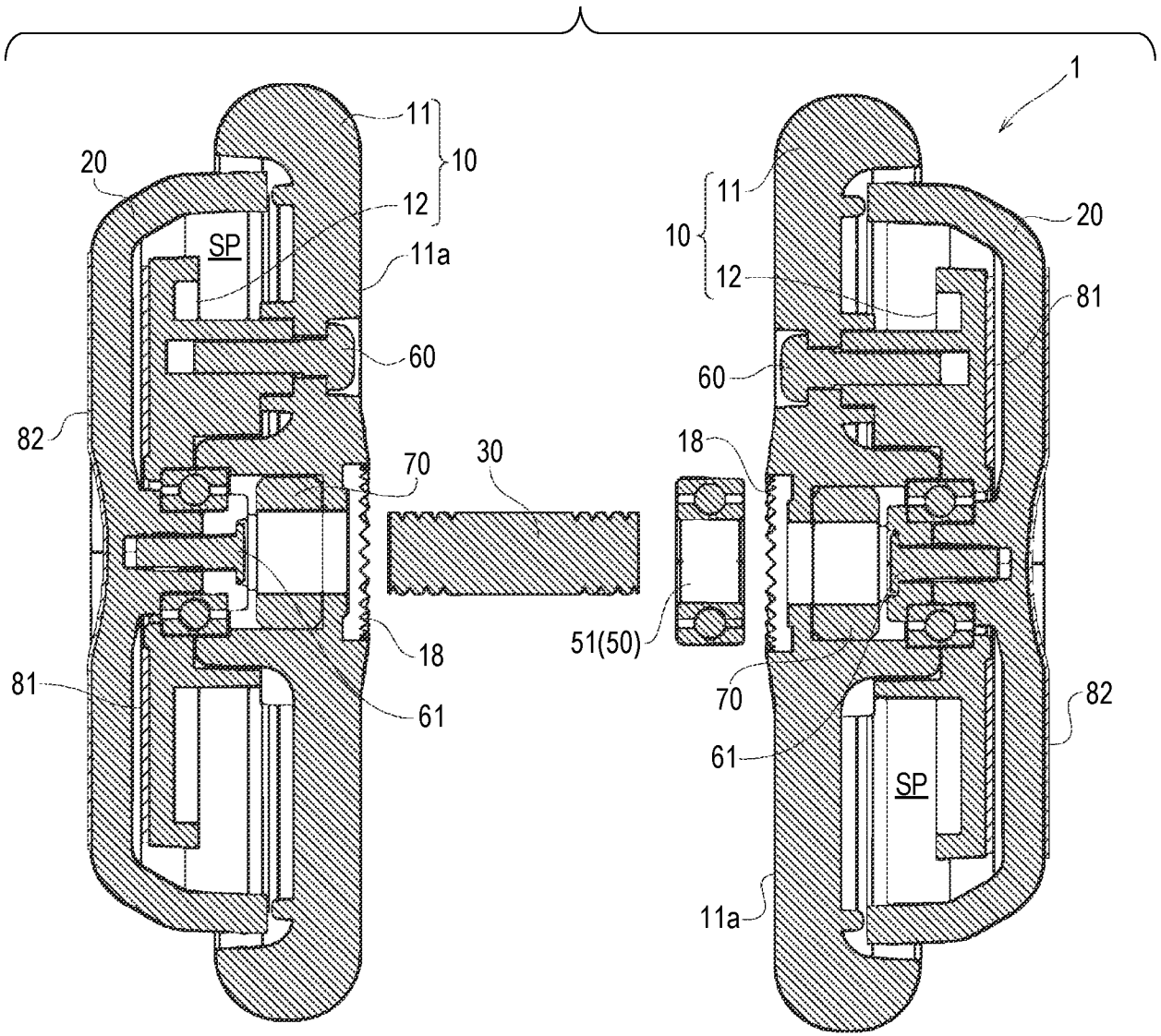
FIG. 6 is a cross-sectional view of the yo-yo shown in FIG. 1 at a final stage of assembly, and a partial exploded perspective view of the yo-yo shown in FIG. 1.

FIG. 3 is a cross-sectional view of the yo-yo shown in FIG. 1 at an initial stage of assembly. FIG. 4 is a cross-sectional view of the yo-yo shown in FIG. 1 at a middle stage of assembly. FIG. 5 is a perspective view of the state shown in FIG. 4. FIG. 6 is a cross-sectional view of the yo-yo shown in FIG. 1 at a final stage of assembly.

When the yo-yo 1 is assembled, first, for example, the first rotation portion 10 is assembled as shown in FIG. 3. In this case, on a main body portion 11 side, a nut 70 is disposed so as to be fitted into a central recess 11*g*. On the other hand, on an interlocking member 12 side, the second bearing 52 is inserted into a recess 12*e* from the inside, and a bearing holding member 71 fixed from the outside is fitted into the second bearing 52. Then, a coupling member 60 such as a screw is screwed into a screw receiving portion 12*d* of the interlocking member 12 from the main body portion 11 side. Thus, the second bearing 52 is sandwiched and fixed between the main body portion 11 and the interlocking member 12.

Thereafter, as shown in FIG. 4, a central boss portion 20*f* of the second rotation portion 20 is fitted into the second bearing 52 from the outside of the interlocking member 12. Then, a rivet 61 is driven into the central boss portion 20*f* from the main body portion 11 side, for example, from the outside of the bearing holding member 71 to couple the first rotation portion 10 and the second rotation portion 20. Accordingly, the second rotation portion 20 is rotatably coupled to the first rotation portion 10 via the second bearing 52.

Here, as shown in FIG. 5, the rotation surface 12*a* and the outer peripheral surface 12*b* of the interlocking member 12 have a first display area E1 in which the first sheet 81 and 20 the third sheet 83 are provided. In the first display area E1, for example, the first information i1 of a geometric pattern such as a polka dot pattern is arranged.

As described above, the second rotation portion 20 includes a second display area E2 in which a second sheet 82 is provided. Second information i2 such as a specific character is shown on the second sheet 82. In order to further improve decorativeness of the first information i1 and the second information i2, it is preferable that the first information i1 is shown entirely on the first display area E1 and the second information i2 is arranged on a partial area of the second display area E2. It is preferable that the second information i2 is not shown on a central portion of the second display area E2 in order to improve the visibility of the first information i1. It is more preferable that the second information i2 is shown near an outer periphery of the second display area E2 in order to improve the visibility of a movement relative to the first information i1. The second sheet 82 may have a circular shape that substantially covers the entire outer surface side of the second rotation portion 20, or may cover a part of the outer surface side of the second rotation portion 20. Here, an area of the second display area E2 is larger than the area of the first display area E1, and in the case of covering the entire outer surface side, the second sheet 82 is made of a light-transmitting material. This improves the visibility of the first display area E1.

Since the second rotation portion 20 is configured as described above, the outer peripheral surface 12*b* of the interlocking member 12 can be seen when the yo-yo 1 is viewed from the front, and the rotation surface 12*a* can be seen when the yo-yo 1 is viewed from the side.

The first rotation portion 10 and the second rotation portion 20 are also assembled on the other side to form a pair of left and right portions. After the components on both the left and right sides are assembled, as shown in FIG. 6, the both end sides of the shaft member 30 through which the first bearing 51 is passed are screwed into the left and right nuts 70 to assemble them. As described above, the yo-yo 1 as shown in FIG. 1 is assembled.

Figure 7:
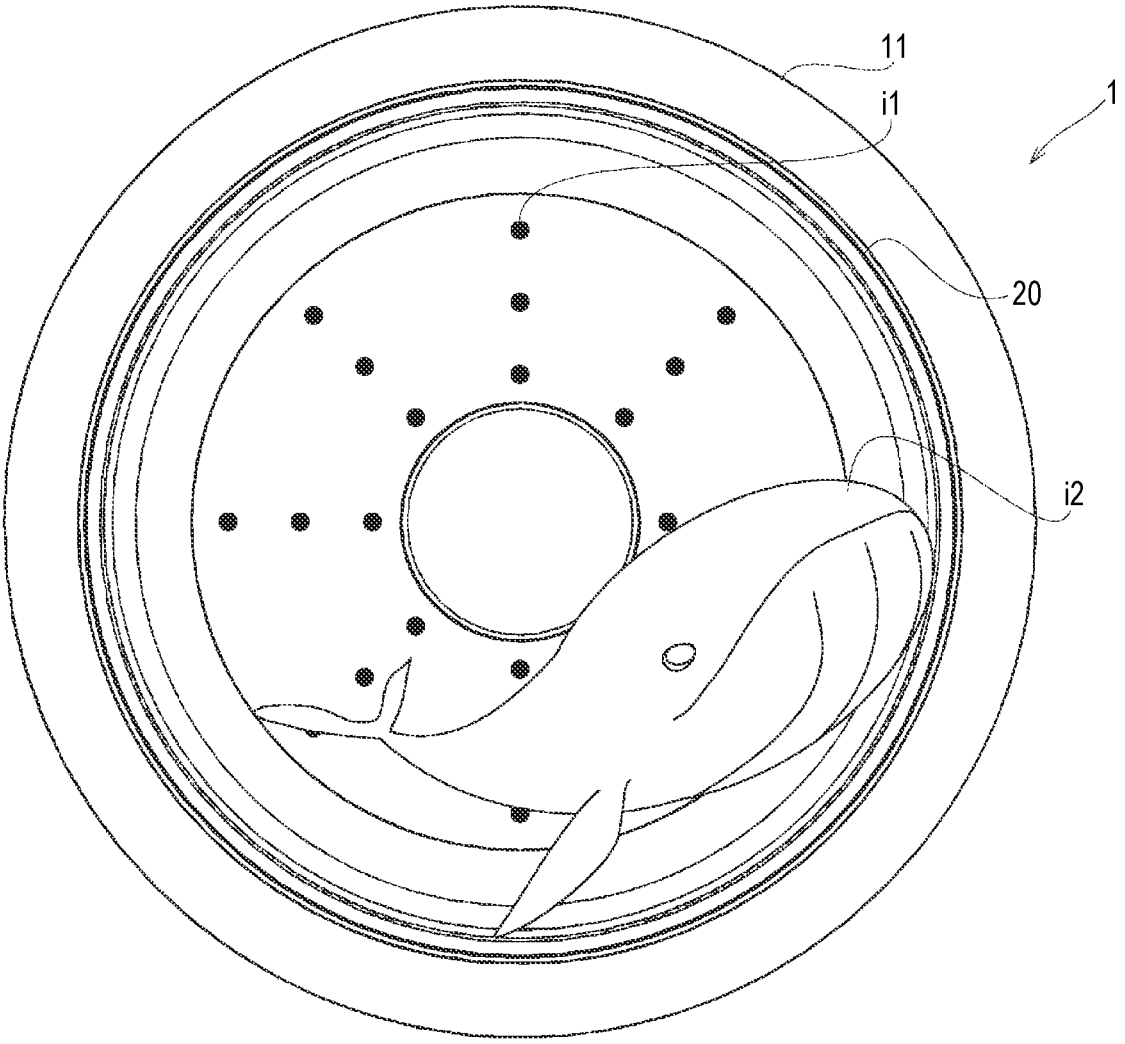
FIG. 7 is a side view of the yo-yo shown in FIG. 1.
Figure 8:
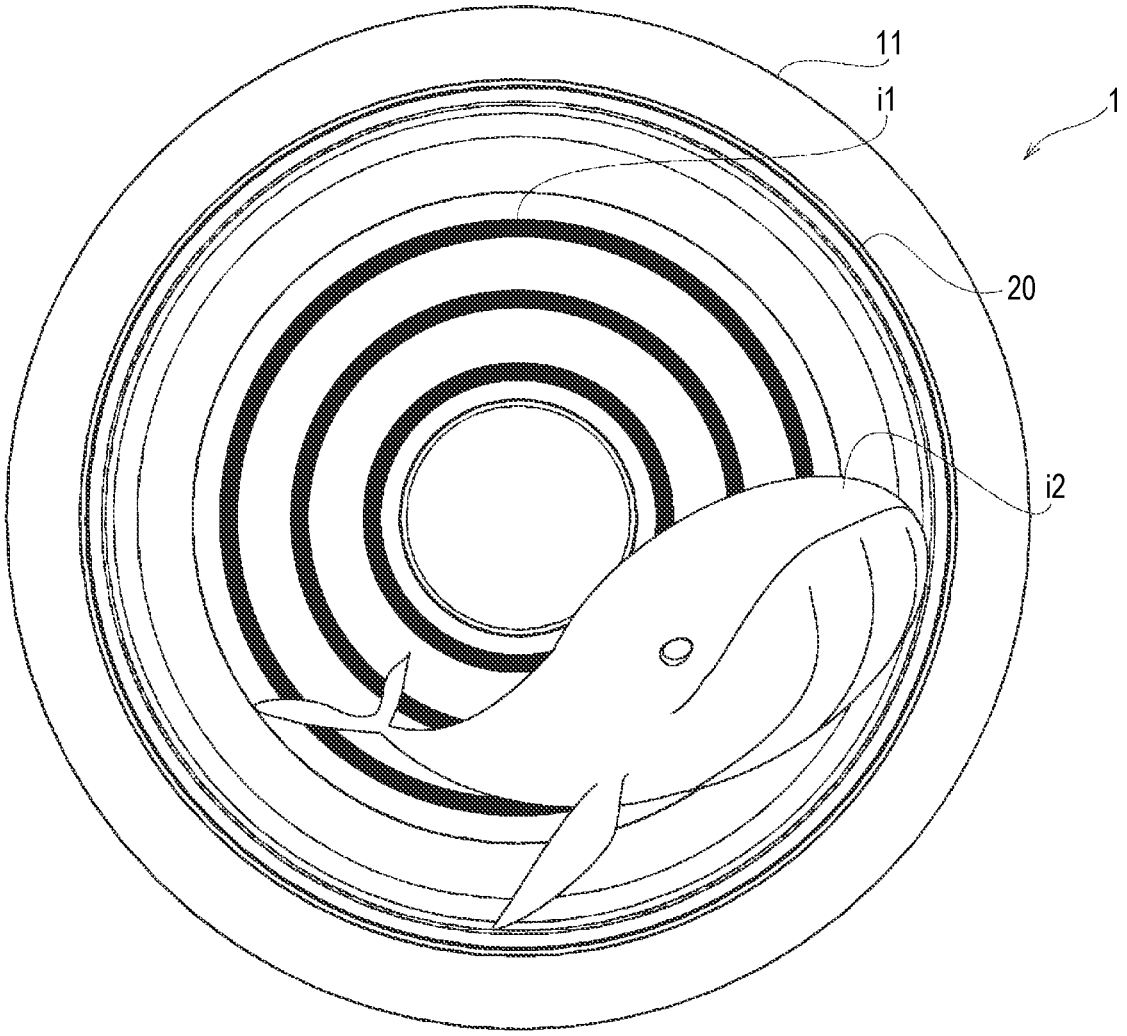
FIG. 8 is a side view showing a rotation state of a main body portion in the yo-yo shown in FIG. 1.

FIG. 7 is a side view of the yo-yo 1 shown in FIG. 1. FIG. 8 is a side view showing a rotation state of the main body portion 11 in the yo-yo 1 shown in FIG. 1.

When the yo-yo 1 is in a state in which the first rotation portion 10 is not rotated, as shown in FIG. 7, the second information i2 (a character (whale) pattern) and the first information i1 (the polka dot pattern) appear simultaneously. On the other hand, in a state in which the first rotation portion 10 is rotating (a state in which the yo-yo 1 is used), as shown in FIG. 8, the first information i1 has a concentric striped circular pattern instead of the polka dot pattern.

That is, the first information i1 of the first display area E1 is visually different between when the interlocking member 12 is rotated and when the interlocking member 12 is stationary.

Figure 9:
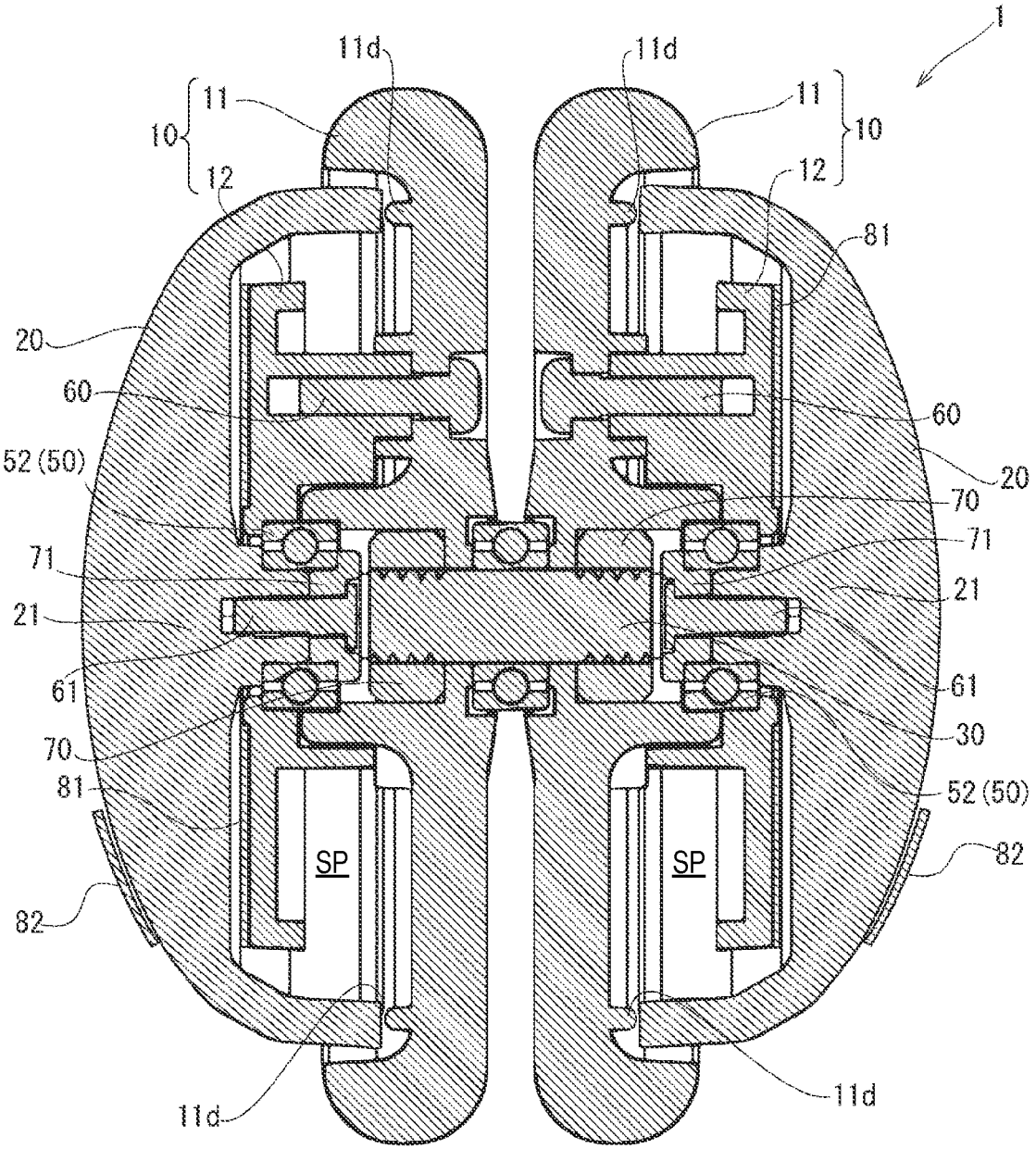
FIG. 9 is a cross-sectional view showing a modification of the present disclosure.

FIG. 9 is a cross-sectional view showing a modification of the present disclosure.

In the present disclosure, the second rotation portion 20 can be configured as shown in FIG. 9. Unlike the case of the configuration shown in FIG. 2, the second rotation portion 20 shown in FIG. 9 is configured such that the outer surface side is not a side surface portion 20*a* that is substantially flat, but a curved surface bulging in the extending direction (left-right direction) of the shaft member 30.

In this case, the entire side surface of the second rotation portion 20 can function as a convex lens. Thereby, the first information i1 appears enlarged, and a shape of the first information i1 appears changed depending on a viewing direction. In the present modification, the second sheet 82 is provided only on a part of an outer side of the second rotation portion 20.

As described above, the yo-yo 1 according to the present embodiment is configured so that the inside of the second rotation portion 20 covering the main body portion 11 of the yo-yo 1 from the outside is visible, and thus it is possible to show internal information in addition to information such as patterns provided on the second rotation portion 20 constituting the outermost surface.

In the yo-yo 1 according to the present embodiment, the interlocking member 12 is provided between the main body portion 11 and the second rotation portion 20, so that the interlocking member 12 can be used as an image display part that is visible through the second rotation portion 20.

In the yo-yo 1 according to the present embodiment, the second rotation portion 20 is configured so that the outer peripheral surface 12*b* of the interlocking member 12 is also visible, and thus it is possible to perform visual presentation not only on the side surface side of the yo-yo 1 but also on an end surface side (a thickness side of the yo-yo 1). In addition, in the yo-yo 1 according to the present embodiment, since the interlocking member 12 has a visual effect different from that of the main body portion 11, decorativeness is improved. As a visual effect, for example, a color effect can be increased by changing a color, and the first information i1 and the second information i2 provided adjacent to each other can be decorated with different colors.

In the yo-yo 1 according to the present embodiment, the interlocking member 12 can be seen through the second rotation portion 20, and it is possible to see information such as patterns provided on the second rotation portion 20 and the interlocking member 12 that are overlapped each other. Further, it is possible to produce visually different images when the yo-yo 1 is in a stationary state (a state in which the first rotation portion 10 is not rotating) and is rotated.

In the yo-yo 1 according to the present embodiment, since the second rotation portion 20 is formed in a dome shape bulging to the side opposite to the first rotation portion 10, the yo-yo 1 can be shaped to be easy to hold. In addition, when the second rotation portion 20 is formed of a transparent member, the second rotation portion 20 can be formed as a convex lens, and the first information i1 of the interlocking member 12 can be enlarged and viewed.

In the yo-yo 1 according to the present embodiment, since the main body portion 11 and the interlocking member 12 are configured to be coupled to the coupling member 60, the combination of the main body portion 11 and the interlocking member 12 can be easily changed. The second bearing 52 is disposed so as to be sandwiched between the main body portion 11 and the interlocking member 12, and can be held and fixed when the interlocking member 12 is assembled. Accordingly, the structure of the yo-yo 1 can be simplified, and the assembly can be facilitated.

In the yo-yo 1 according to the present embodiment, since the recess 21 is formed in the side surface portion 20*a* of the second rotation portion 20, the yo-yo 1 is easily held when holding the yo-yo 1. In addition, the distal end edge 20*c* of the second rotation portion 20 is provided at a position facing the abutting portion 11*d*. Accordingly, for example, even when the left and right side surface portions 20*a* of the second rotation portion 20 are gripped to be pressed with a large force, the abutting portion 11*d* and the distal end edge 20*c* are abutted against each other, and the second rotation portion 20 and the rotation surface 12*a* of the interlocking member 12 are separated from each other to maintain a gap therebetween, so that the movements can be prevented from being interfered.

Although one embodiment of the present disclosure has been described above, the present disclosure can be appropriately modified within the scope of the technical idea thereof. For example, in the embodiment described above, the first display area E1 is both the rotation surface 12*a* of the interlocking member 12 and the outer peripheral surface 12*b* of the interlocking member 12, but the present disclosure is not limited to this, and may be either one.

The present disclosure is summarized as follows.

(1) A yo-yo including:

a shaft member;

a string member supported by the shaft member;

a first rotation portion rotatable around the shaft member; and a second rotation portion rotatable around the shaft member and rotatable relative to the corresponding first rotation portion, in which the second rotation portion is provided outside the first rotation portion in a direction in which the shaft member extends, the second rotation portion covers a partial area of the first rotation portion, and at least a part of the partial area is visible through the second rotation portion.

(2) The yo-yo according to (1), in which the first rotation portion includes:

a main body portion rotatably supported by the shaft member; and an interlocking member provided between the main body portion and the second rotation portion and interlocking with rotation of the main body portion, and at least a part of the interlocking member is visible through the second rotation portion.

The yo-yo according to (2), in which the interlocking member and the second rotation portion are provided at positions on both sides sandwiching the main body portions.

The yo-yo according to claim 3, in which the interlocking member is disposed in a space surrounded by the main body portion and the second rotation portion.

The yo-yo according to (2), in which the interlocking member has a thin plate-shaped rotation surface rotatable around the shaft member as a rotation axis.

The yo-yo according to (5), in which
the rotation surface is disposed close to the second rotation portion.
The yo-yo according to (5), in which
the rotation surface is provided on an end portion in an axial direction of the shaft member, and
at least a part of the rotation surface is visible through the second rotation portion.
The yo-yo according to (7), in which
an outer peripheral surface of the interlocking member is visible through the second rotation portion.
The yo-yo according to (5), in which
the interlocking member has a first display area showing first information.
The yo-yo according to (9), in which
the first display area is configured to show visually different information between when the interlocking member is rotated and when the interlocking member is stationary.
The yo-yo according to (10), in which
the first display area is provided on at least one of the rotation surface of the interlocking member and an outer peripheral surface of the interlocking member.
The yo-yo according to (9), in which
the second rotation portion has a second display area showing second information different from the first information, and
an area of the first display area is smaller than an area of the second display area.
The yo-yo according to (2), in which
the interlocking member has a visual effect different from a visual effect of the main body portion.
The yo-yo according to (1), in which
the second rotation portion is formed in a dome shape bulging to a side opposite to the first rotation portion.
The yo-yo according to (1), in which
the second rotation portion is formed of a transparent member.
The yo-yo according to (2), in which
the main body portion and the interlocking member are coupled to each other by a coupling member with a bearing sandwiched therebetween.
The yo-yo according to claim 16, in which
the main body portion and the second rotation portion are coupled by a coupling member.
The yo-yo according to (2), in which
the main body portion has an abutting portion abuttable against an edge of the second rotation portion, and
the rotation surface of the interlocking member and the second rotation portion are separated from each other when the edge and the abutting portion abuts against each other.
The yo-yo according to (1), in which
the second rotation portion has a recess on an end surface in the direction in which the shaft member extends.

According to the technique of the present disclosure, it is possible to provide the yo-yo with improved interest.

The invention claimed is:

1. A yo-yo comprising:
a shaft member;
a string member supported by the shaft member;
a first rotation portion rotatable around the shaft member;
a second rotation portion rotatable around the shaft member and rotatable relative to the first rotation portion; and
a bearing by which the second rotation portion is rotatable relative to the first rotation portion, wherein
the first rotation portion includes a main body portion rotatably supported by the shaft member, an interlocking member interlocking with rotation of the main body portion, and a coupling member coupling the interlocking member with the main body portion,
the main body portion and the interlocking member are coupled to each other by the coupling member with the bearing sandwiched therebetween,
the second rotation portion is provided outside the first rotation portion in a direction in which the shaft member extends,
the second rotation portion covers at least a part of the interlocking member, and
at least a part of the interlocking member is visible through the second rotation portion.

2. The yo-yo according to claim 1, wherein
the main body portion is sandwiched between the interlocking member and the second rotation portion.

3. The yo-yo according to claim 2, wherein
the interlocking member is disposed in a space surrounded by the main body portion and the second rotation portion.

4. The yo-yo according to claim 1, wherein
the interlocking member has a thin plate-shaped rotation surface rotatable around the shaft member as a rotation axis.

5. The yo-yo according to claim 4, wherein
the rotation surface is disposed close to the second rotation portion.

6. The yo-yo according to claim 4, wherein
the rotation surface is provided on an end portion in an axial direction of the shaft member, and
at least a part of the rotation surface is visible through the second rotation portion.

7. The yo-yo according to claim 6, wherein
an outer peripheral surface of the interlocking member is visible through the second rotation portion.

8. The yo-yo according to claim 4, wherein
the interlocking member has a first display area showing first information.

9. The yo-yo according to claim 8, wherein
the first display area is configured to show visually different information between when the interlocking member is rotated and when the interlocking member is stationary.

10. The yo-yo according to claim 9, wherein
the first display area is provided on at least one of the rotation surface of the interlocking member and an outer peripheral surface of the interlocking member.

11. The yo-yo according to claim 8, wherein
the second rotation portion has a second display area showing second information different from the first information, and
an area of the first display area is smaller than an area of the second display area.

12. The yo-yo according to claim 4, wherein
the main body portion has an abutting portion abuttable against an edge of the second rotation portion, and
a rotation surface of the interlocking member and the second rotation portion are separated from each other when the edge and the abutting portion abut against each other.

13. The yo-yo according to claim 1, wherein
the interlocking member has a visual effect different from a visual effect of the main body portion.

14. The yo-yo according to claim 1, wherein the second rotation portion is formed in a dome shape bulging to a side opposite to the first rotation portion.

15. The yo-yo according to claim 1, wherein the second rotation portion is formed of a transparent member.

16. The yo-yo according to claim 1, wherein the second rotation portion has a recess on an end surface in the direction in which the shaft member extends.

17. The yo-yo according to claim 1, wherein the coupling member is inserted from inside of the yo-yo toward outside of the yo-yo to couple the interlocking member with the main body portion, and a distal end of the coupling member is accommodated in the interlocking member.

* * * * *